US008670571B2

(12) United States Patent
Clemow

(10) Patent No.: US 8,670,571 B2
(45) Date of Patent: Mar. 11, 2014

(54) FREQUENCY CONTROL BASED ON DEVICE PROPERTIES

(75) Inventor: Richard Clemow, Gerrards Cross (GB)

(73) Assignee: Wolfson Microelectronics plc, Edinburgh (GB)

( * ) Notice: Subject to any disclaimer, the term of this patent is extended or adjusted under 35 U.S.C. 154(b) by 398 days.

(21) Appl. No.: 12/809,028

(22) PCT Filed: Dec. 12, 2008

(86) PCT No.: PCT/GB2008/051185

§ 371 (c)(1),
(2), (4) Date: Jul. 15, 2010

(87) PCT Pub. No.: WO2009/081190

PCT Pub. Date: Jul. 2, 2009

(65) Prior Publication Data

US 2010/0322432 A1 Dec. 23, 2010

(30) Foreign Application Priority Data

Dec. 21, 2007 (GB) ..... 0725117.6
Jun. 16, 2008 (GB) ..... 0810998.5

(51) Int. Cl.
*H04R 5/033* (2006.01)

(52) U.S. Cl.
USPC ..... 381/71.1; 381/71.5; 381/71.6; 381/74; 381/96

(58) Field of Classification Search
USPC ..... 381/71.1, 71.5, 71.6, 74, 94.1, 94.2, 381/94.3, 94.9, 99, 96
See application file for complete search history.

(56) References Cited

U.S. PATENT DOCUMENTS

| | | | | |
|---|---|---|---|---|
| 4,930,113 | A | 5/1990 | Sallas | |
| 5,068,903 | A | 11/1991 | Walker | |
| 5,410,607 | A | 4/1995 | Mason et al. | |
| 5,719,526 | A * | 2/1998 | Fink | 330/2 |
| 5,937,070 | A * | 8/1999 | Todter et al. | 381/71.6 |
| 5,994,890 | A * | 11/1999 | Kajiwara et al. | 324/76.21 |

(Continued)

FOREIGN PATENT DOCUMENTS

| | | | |
|---|---|---|---|
| EP | 1 489 594 | A2 | 12/2004 |
| GB | 2 445 984 | A | 7/2008 |
| IT | TO 940 865 | A1 | 4/1996 |
| WO | WO 92/05538 | A1 | 4/1992 |

OTHER PUBLICATIONS

L. R. Fincham, "Refinements in the Impulse Testing of Loudspeakers", 8013 Journal of the Audio Engineering Society, vol. 33, Mar. 1985, No. 3, New York, USA pp. 133-140.

*Primary Examiner* — Duc Nguyen
*Assistant Examiner* — George Monikang
(74) *Attorney, Agent, or Firm* — Dickstein Shapiro LLP

(57) ABSTRACT

There is provided a method of controlling a noise cancellation system, the noise cancellation system being for use in a device comprising a speaker for receiving a wanted signal and generating a sound signal therefrom, and the noise cancellation system comprising: a digital filter, for generating a noise cancellation signal from an input signal representative of ambient noise; and an output for applying the noise cancellation signal to the speaker in addition to the wanted signal to generate a sound signal from which the ambient noise has been at least partially cancelled. The method comprises: determining a resonant frequency of the speaker; based on the determined resonant frequency, selecting a set of filter coefficients; and applying the selected set of filter coefficients to the digital filter.

21 Claims, 4 Drawing Sheets

(56) References Cited

U.S. PATENT DOCUMENTS 6,188,979 B1 * 2/2001 Ashley ..... 704/205
2003/0185403 A1 * 10/2003 Sibbald ..... 381/71.6
2006/0153403 A1 * 7/2006 Lechner ..... 381/102
2007/0241711 A1 * 10/2007 Finamore et al. ..... 318/561
2008/0130918 A1 * 6/2008 Kimijima ..... 381/107

* cited by examiner

FREQUENCY CONTROL BASED ON DEVICE PROPERTIES

This invention relates to a noise cancellation system, and in particular to a noise cancellation system having a filter that can easily be adapted based on the properties of a device in which the system is being used, in order to improve the noise cancellation performance.

BACKGROUND

Noise cancellation systems are known, in which an electronic noise signal representing ambient noise is applied to a signal processing circuit, and the resulting processed noise signal is then applied to a speaker, in order to generate a sound signal. In order to achieve noise cancellation, the generated sound should approximate as closely as possible the inverse of the ambient noise, in terms of its amplitude and its phase.

In particular, feedforward noise cancellation systems are known, for use with headphones or earphones, in which one or more microphones mounted on the headphones or earphones detect an ambient noise signal in the region of the wearer's ear. In order to achieve noise cancellation, the generated sound then needs to approximate as closely as possible the inverse of the ambient noise, after that ambient noise has itself been modified by the headphones or earphones. One example of modification by the headphones or earphones is caused by the different acoustic path the noise must take to reach the wearer's ear, travelling around the edge of the headphones or earphones.

The microphone used to detect the ambient noise signal and the loudspeaker used to generate the sound signal from the processed noise signal will in practice also modify the signals, for example being more sensitive at some frequencies than at others. One example of this is when the speaker is closely coupled to the ear of a user, causing the frequency response of the loudspeaker to change due to cavity effects.

Thus, the signal processing circuit should ideally be able to compensate for all of these effects. In order to be able to achieve this compensation, a relatively complex filter, for example a digital filter such as an infinite response (IIR) filter may be useful. However, it would be disadvantageous to have to perform full adaptation on a complex filter, such as an IIR filter, in use of the device.

SUMMARY OF INVENTION

According to a first aspect of the present invention, there is provided a method of controlling a noise cancellation system, the noise cancellation system being for use in a device comprising a speaker for receiving a wanted signal and generating a sound signal therefrom, and the noise cancellation system comprising: a digital filter, for generating a noise cancellation signal from an input signal representative of ambient noise; and an output for applying the noise cancellation signal to the speaker in addition to the wanted signal to generate a sound signal from which the ambient noise has been at least partially cancelled. The method comprises: determining a resonant frequency of the speaker; based on the determined resonant frequency, selecting a set of filter coefficients; and applying the selected set of filter coefficients to the digital filter.

This has the advantage that the filter characteristics can be adjusted, based on the properties of the device with which the noise cancellation system is being used.

According to a second aspect of the present invention, there is provided a noise cancellation for performing the method as outlined above.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1:
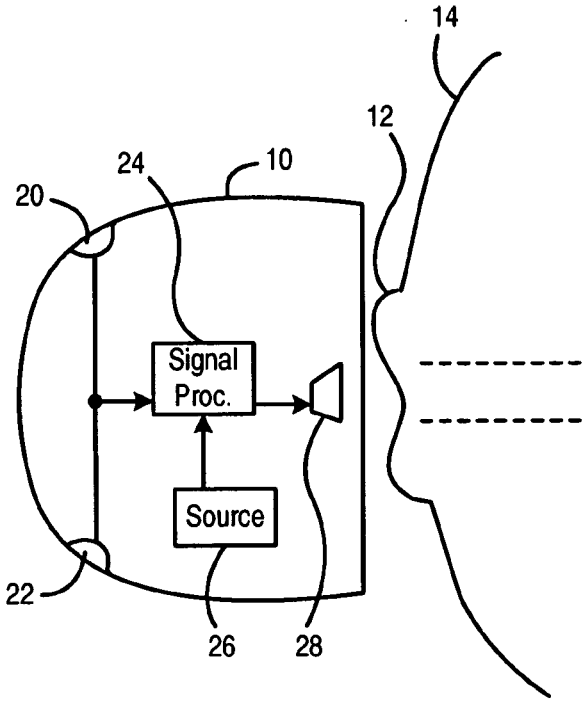
FIG. 1 illustrates a noise cancellation system in accordance with an aspect of the invention.

FIG. 1 illustrates in general terms the form and use of a noise cancellation system in accordance with the present invention.

Specifically, FIG. 1 shows an earphone 10, being worn on the outer ear 12 of a user 14. Thus, FIG. 1 shows a supra-aural earphone that is worn on the ear, although it will be appreciated that exactly the same principle applies to circumaural headphones worn around the ear and to earphones worn in the ear such as so-called ear-bud phones. The invention is equally applicable to other devices intended to be worn or held close to the user's ear, such as mobile phones and other communication devices.

Ambient noise is detected by microphones 20, 22, of which two are shown in FIG. 1, although any number more or less than two may be provided. Ambient noise signals generated by the microphones 20, 22 are combined, and applied to signal processing circuitry 24, which will be described in more detail below. In one embodiment, where the microphones 20, 22 are analogue microphones, the ambient noise signals may be combined by adding them together. Where the microphones 20, 22 are digital microphones, i.e. where they generate a digital signal representative of the ambient noise, the ambient noise signals may be combined alternatively, as will be familiar to those skilled in the art. Further, the microphones could have different gains applied to them before they are combined, for example in order to compensate for sensitivity differences due to manufacturing tolerances.

This illustrated embodiment of the invention also contains a source 26 of a wanted signal. For example, where the noise cancellation system is in use in an earphone, such as the earphone 10, that is intended to be able to reproduce music, the source 26 may be an inlet connection for a wanted signal from an external source such as a sound reproducing device. In other applications, for example where the noise cancellation system is in use in a mobile phone or other communication device, the source 26 may include wireless receiver circuitry for receiving and decoding radio frequency signals. In other embodiments, there may be no source, and the noise cancellation system may simply be intended to cancel the ambient noise for the user's comfort.

The wanted signal, if any, from the source 26 is applied through the signal processing circuitry 24 to a loudspeaker 28, which generates a sound signal in the vicinity of the user's ear 12. In addition, the signal processing circuitry 24 generates a noise cancellation signal that is also applied to the loudspeaker 28.

One aim of the signal processing circuitry 24 is to generate a noise cancellation signal, which, when applied to the loudspeaker 28, causes it to generate a sound signal in the ear 12 of the user that is the inverse of the ambient noise signal reaching the ear 12.

In order to achieve this, the signal processing circuitry 24 needs to generate from the ambient noise signals generated by the microphones 20, 22 a noise cancellation signal that takes into account the properties of the microphones 20, 22 and of the loudspeaker 28, and also takes into account the modification of the ambient noise that occurs due to the presence of the earphone 10.

Figure 2:
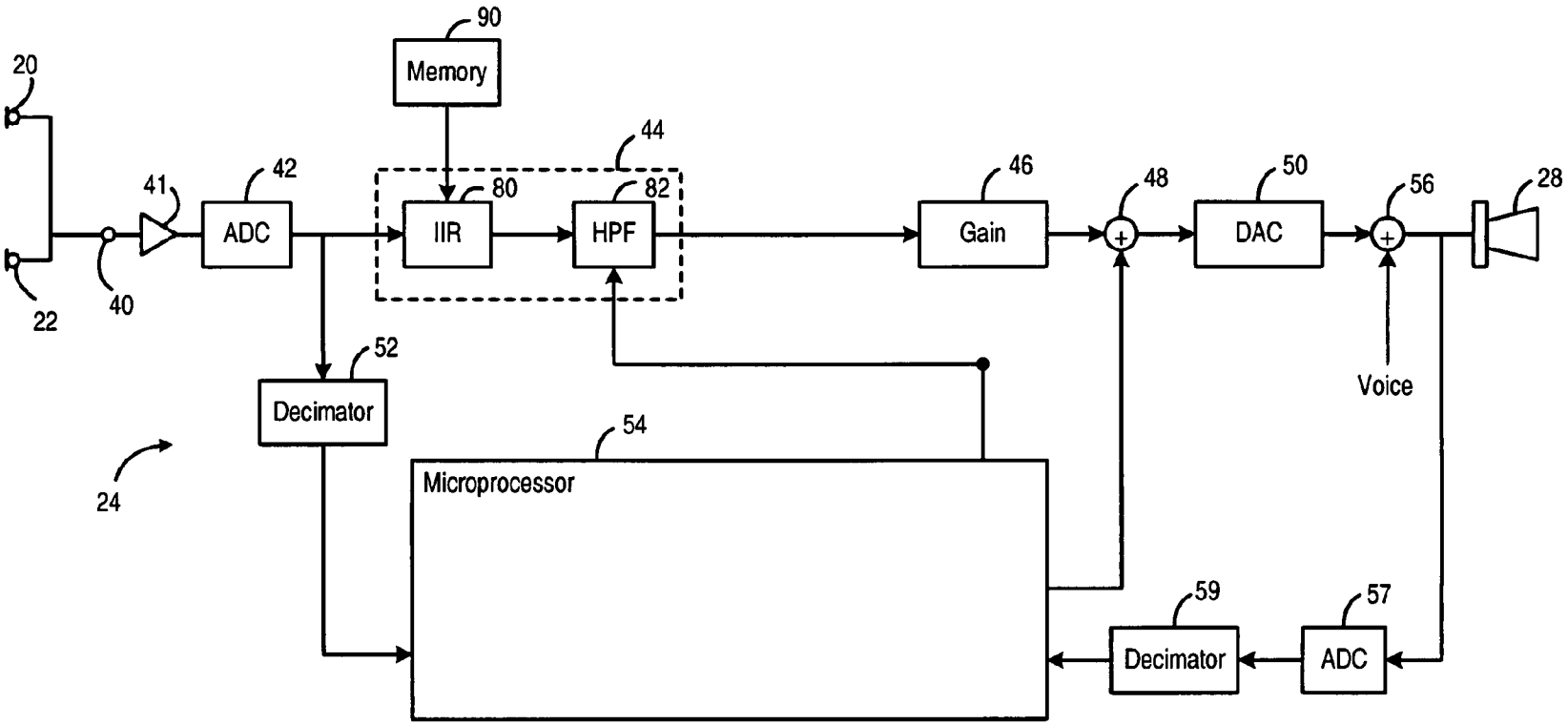
FIG. 2 illustrates a signal processing circuit in accordance with an aspect of the invention in the noise cancellation system of FIG. 1.

FIG. 2 shows in more detail the form of the signal processing circuitry 24. An input 40 is connected to receive an input signal, for example directly from the microphones 20, 22. This input signal is amplified in an amplifier 41 and the amplified signal is applied to an analog-digital converter 42, where it is converted to a digital signal. The digital signal is applied to an adaptive digital filter 44, and the filtered signal is applied to an adaptable gain device 46. Those skilled in the art will appreciate that in the case where the microphones 20, 22 are digital microphones, wherein an analog-digital converter is incorporated into the microphone capsule and the input 40 receives a digital input signal, the analog-digital converter 42 is not required.

The resulting signal is applied to a first input of an adder 48, the output of which is applied to a digital-analog converter 50. The output of the digital-analog converter 50 is applied to a first input of a second adder 56, the second input of which receives a wanted signal from the source 26. The output of the second adder 56 is passed to the loudspeaker 28. Those skilled in the art will further appreciate that the wanted signal may be input to the system in digital form. In this instance, the adder 56 may be located prior to the digital-analog converter 50, and thus the combined signal output from the adder 56 is converted to analog before being output through the speaker 28.

Thus, the filtering and level adjustment applied by the filter 44 and the gain device 46 are intended to generate a noise cancellation signal that allows the detected ambient noise to be cancelled.

As mentioned above, the noise cancellation signal is produced from the input signal by the adaptive digital filter 44 and the adaptive gain device 46. These are controlled by a control signal, which is generated by applying the digital signal output from the analog-digital converter 42 to a decimator 52 which reduces the digital sample rate, and then to a microprocessor 54.

In this illustrated embodiment of the invention, the adaptive filter 44 is made up a first filter stage 80, in the form of a fixed IIR filter 80, and a second filter stage, in the form of an adaptive high-pass filter 82.

The microprocessor 54 generates a control signal, which is applied to the adaptive high-pass filter 82 in order to adjust a corner frequency thereof. The microprocessor 54 generates the control signal on an adaptive basis in use of the noise cancellation system, so that the properties of the filter 44 can be adjusted based on the properties of the detected noise signal.

However, the invention is equally applicable to systems in which the filter 44 is fixed. In this context, the word "fixed" means that the characteristic of the filter is not continually adjusted on the basis of the detected noise signal.

However, the characteristic of the filter 44 can be adjusted in a calibration phase, which may for example take place when the system 24 is manufactured, or when it is first integrated with the microphones 20, 22 and speaker 28 in a complete device, or whenever the system is powered on, or at other irregular intervals.

More specifically, the characteristic of the fixed IIR filter 80 can be adjusted in this calibration phase by downloading to the filter 80 a replacement set of filter coefficients, from multiple sets of coefficients stored in a memory 90. For example, the downloading of a replacement set of coefficients may be controlled by the microprocessor 54.

Further, the gain applied by the adjustable gain element 46 can similarly be adjusted in the calibration phase. Alternatively, a change in the gain can be achieved during the calibration phase by suitable adjustment of the characteristic of the fixed IIR filter 80.

In this way, the signal processing circuitry 24 can be optimized for the specific device with which it is to be used.

The signal processing circuitry 24 is intended for use in a wide range of devices. However, it is anticipated that large numbers of devices containing the signal processing circuitry 24 will be manufactured, with each one being included in a larger device containing the microphones 20, 22 and the speaker 28. Although these larger devices will be nominally identical, every microphone and every speaker may be slightly different. The present invention proceeds from the recognition that one of the more significant of these differences will be differences in the resonant frequency of the speaker 28 from one device to another. The invention further proceeds from the recognition that the resonant frequency of the speaker 28 may vary in use of the device, as the temperature of the speaker coil varies. However, other causes of resonant frequency variation are possible, including ageing, or changing humidity, etc. The present invention is equally applicable in all such cases.

Figure 3:
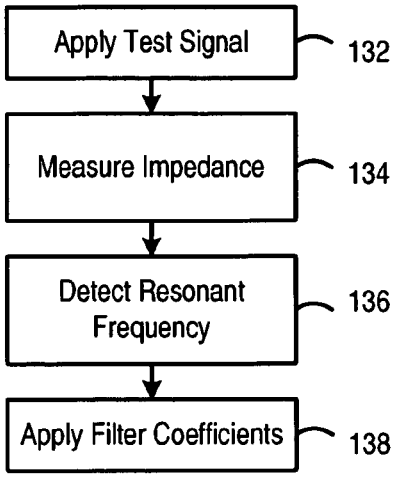
FIG. 3 is a flow chart, illustrating a method of calibrating a noise cancellation system in accordance with an aspect of the invention.

FIG. 3 is a flow chart, illustrating a method in accordance with the invention. In step 132, a test signal is generated by the microprocessor 54, and applied to the second input of the adder 48. In one embodiment, the test signal is a concatenation of sinusoid signals at a plurality of frequencies. These frequencies cover a frequency range in which the resonant frequency of the speaker 28 is expected to lie.

In step 134, the impedance of the speaker is determined. That is, based on the applied test signal, the current flowing through the speaker coil is measured. For example, the current in the speaker coil may be detected, and passed through an analog-digital converter 57 and decimator 59 to the microprocessor 54. Conveniently, the microprocessor may determine the impedance at each frequency by applying the detected current signal to a digital Fourier transform block (not illustrated) and measuring the magnitude of the current waveform at each frequency. Alternatively, signals at different frequencies can be detected by appropriately adjusting the rate at which samples are generated by the decimator 59.

In step 136 of the process, the resonant frequency is determined, being the frequency at which the current is a minimum, and hence the impedance is a maximum, within a frequency band which spans the range of possible resonant frequencies.

In step 138, the frequency characteristic of the filter 44 is adjusted, based on the detected resonant frequency. In one embodiment, the memory 90 stores a plurality of sets of filter coefficients, with each set of filter coefficients defining an IIR filter having a characteristic that contains a peak at a particular frequency. These particular frequencies can advantageously be the same as the frequencies of the sinusoid signals making up the test signal. In this case, it is advantageous to apply to the adaptive IIR filter a set of coefficients defining a filter that has a peak at the detected resonant frequency.

In one embodiment of the invention, the sets of filter coefficients each define sixth order filters, with the resonant frequencies of these filter characteristics being the most substantial difference between them.

It is thus possible to detect the resonant frequency of the speaker, and select a filter which has a characteristic that matches this most closely.

In embodiments of the invention, the microprocessor 54 may contain an emulation of the filter 44, in order to allow adaptation of the filter characteristics of the filter 44 based on the detected noise signal. In this case, any filter characteristic that is applied to the filter 44 should preferably also be applied to the filter emulation in the microprocessor 54.

The invention has been described so far with reference to an embodiment in which one of a plurality of prestored sets of filter coefficients is applied to the filter. However, it is equally possible to calculate the required filter coefficients based on the detected resonant frequency and any other desired properties.

In one embodiment of the invention, this calibration process is performed when the signal processing circuitry 24 is first included in the larger device containing the microphones 20, 22 and the speaker 28, or when the device is first powered on, for example.

In addition, it has been noted that the resonant frequency of a speaker can change with temperature, for example as the temperature of the speaker coil increases with use of the device. It is therefore advantageous to perform this calibration in use of the device or after a period of use.

If it is desired to perform the calibration while the device is in use, the useful signal (i.e. the sum of the wanted signal and the noise cancellation signal) through the speaker 28 (for example during a call in the case where the device is a mobile phone) can be used as the test signal.

It will be apparent to those skilled in the art that the present invention is equally applicable to so-called feedback noise cancellation systems.

The feedback method is based upon the use, inside the cavity that is formed between the ear and the inside of an earphone shell, or between the ear and a mobile phone, of a microphone placed directly in front of the loudspeaker. Signals derived from the microphone are coupled back to the loudspeaker via a negative feedback loop (an inverting amplifier), such that it forms a servo system in which the loudspeaker is constantly attempting to create a null sound pressure level at the microphone.

Figure 4:
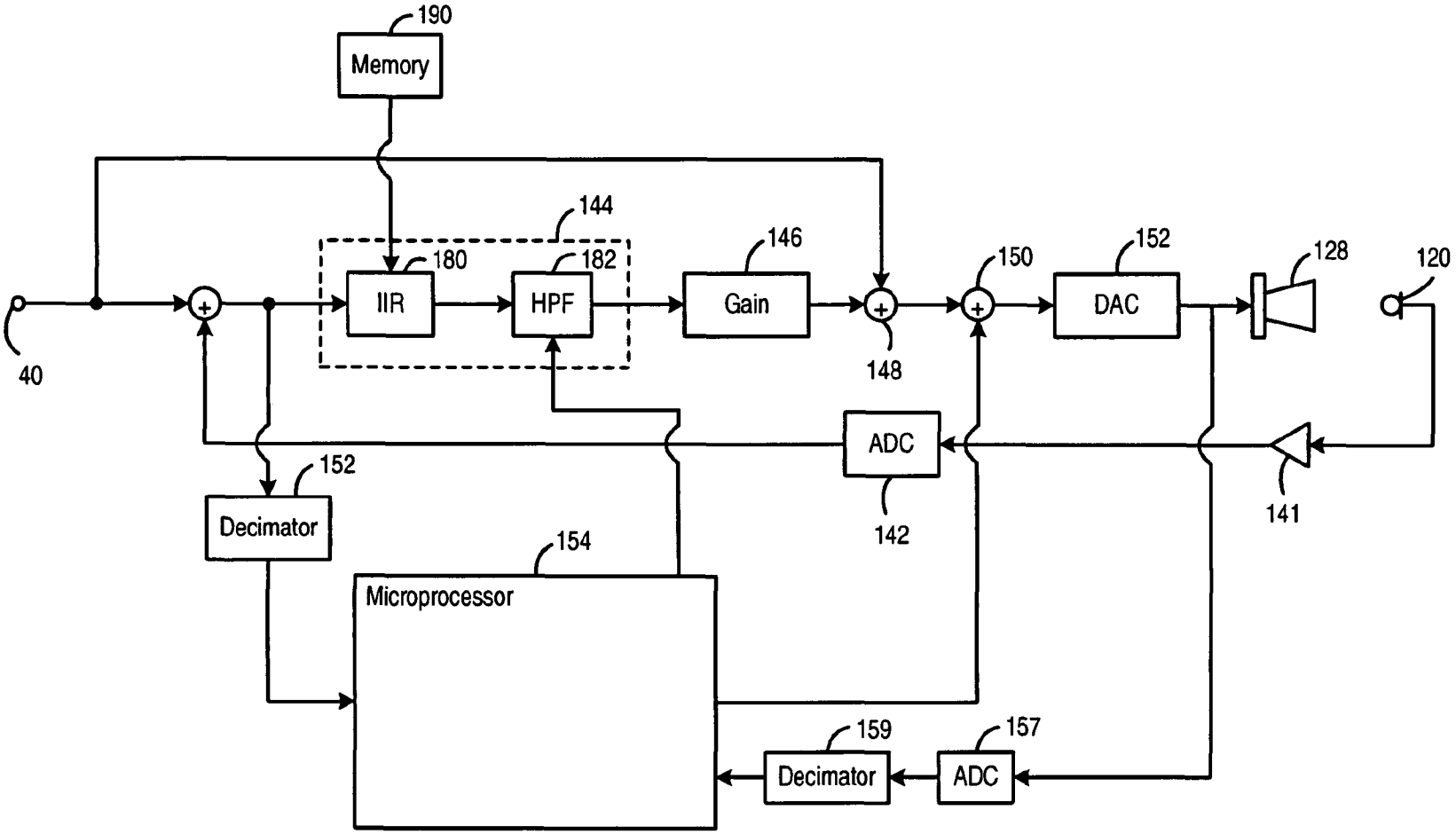
FIG. 4 illustrates a signal processing circuit appropriate for use in a feedback noise cancellation system in accordance with the present invention.

FIG. 4 shows an example of signal processing circuitry according to the present invention when implemented in a feedback system.

The feedback system comprises a microphone 120 positioned substantially in front of a loudspeaker 128. The microphone 120 detects the output of the loudspeaker 128, with the detected signal being fed back via an amplifier 141 and an analog-to-digital converter 142. A wanted audio signal is fed to the processing circuitry via an input 140. The fed back signal is subtracted from the wanted audio signal in a subtracting element 188, in order that the output of the subtracting element 188 substantially represents the ambient noise, i.e. the wanted audio signal has been substantially cancelled.

Thereafter, the processing circuitry is substantially similar to that in the feed forward system described with respect to FIG. 2. The output of the subtracting element 188 is fed to an adaptive digital filter 144, and the filtered signal is applied to an adaptable gain device 146.

The resulting signal is applied to an adder 148, where it is summed with the wanted audio signal received from the input 140.

Thus, the filtering and level adjustment applied by the filter 144 and the gain device 146 are intended to generate a noise cancellation signal that allows the detected ambient noise to be cancelled.

As mentioned above, the noise cancellation signal is produced by the adaptive digital filter 144 and the adaptive gain device 146. These are controlled by a control signal, which is generated by applying the signal output from the subtracting element 188 to a decimator 152 which reduces the digital sample rate, and then to a microprocessor 154.

In this illustrated embodiment of the invention, the adaptive filter 144 is made up a first filter stage 180, in the form of a fixed IIR filter 180, and a second filter stage, in the form of an adaptive high-pass filter 182.

The microprocessor 154 generates a control signal, which is applied to the adaptive high-pass filter 182 in order to adjust a corner frequency thereof. The microprocessor 54 generates the control signal on an adaptive basis in use of the noise cancellation system, so that the properties of the filter 144 can be adjusted based on the properties of the detected noise signal.

However, the invention is equally applicable to systems in which the filter 144 is fixed. In this context, the word "fixed" means that the characteristic of the filter is not continually adjusted on the basis of the detected noise signal.

However, the characteristic of the filter 144 can be adjusted in a calibration phase, which may for example take place when the system is manufactured, or when it is first integrated with the microphones 120 and speaker 128 in a complete device, or whenever the system is powered on, or at other irregular intervals.

More specifically, the characteristic of the fixed IIR filter 180 can be adjusted in this calibration phase by downloading to the filter 180 a replacement set of filter coefficients, from multiple sets of coefficients stored in a memory 190.

Further, the gain applied by the adjustable gain element 146 can similarly be adjusted in the calibration phase. Alternatively, a change in the gain can be achieved during the calibration phase by suitable adjustment of the characteristic of the fixed IIR filter 180.

In this way, the signal processing circuitry can be optimized for the specific device with which it is to be used.

The current in the speaker coil may be detected, and passed through an analog-digital converter 157 and decimator 159 to the microprocessor 154. Conveniently, the microprocessor may determine the impedance at each frequency by applying the detected current signal to a digital Fourier transform block (not illustrated) and measuring the magnitude of the current waveform at each frequency. Alternatively, signals at different frequencies can be detected by appropriately adjusting the rate at which samples are generated by the decimator 159.

It will be clear to those skilled in the art that the implementation may take one of several hardware or software forms, and the intention of the invention is to cover all these different forms.

Noise cancellation systems according to the present invention may be employed in many devices, as would be appreciated by those skilled in the art. For example, they may be employed in mobile phones, headphones, earphones, headsets, etc.

The skilled person will recognise that the above-described apparatus and methods may be embodied as processor control code, for example on a carrier medium such as a disk, CD- or DVD-ROM, programmed memory such as read only memory (firmware), or on a data carrier such as an optical or electrical signal carrier. For many applications, embodiments of the invention will be implemented on a DSP (digital signal processor), ASIC (application specific integrated circuit) or FPGA (field programmable gate array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (very high speed integrated circuit hardware description language). As the skilled person will appreciate, the code may be distributed between a plurality of coupled components in communication with one another. Where appropriate, the embodiments may also be implemented using code running on a field-(re-)programmable analogue array or similar device in order to configure analogue/digital hardware.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single processor or other unit may fulfil the functions of several units recited in the claims. Any reference signs in the claims shall not be construed so as to limit their scope.

The invention claimed is:

1. A method of controlling a noise cancellation system, the noise cancellation system being for use in a device comprising a speaker for receiving a wanted signal and generating a sound signal therefrom, and the noise cancellation system comprising: a digital filter, for generating a noise cancellation signal from an input signal representative of ambient noise; and an output for applying the noise cancellation signal to the speaker in addition to the wanted signal to generate a sound signal from which the ambient noise has been at least partially cancelled, the method comprising:

determining a resonant frequency of the speaker;

in response to the determination of the resonant frequency, selecting a set of filter coefficients from a plurality of prestored sets of filter coefficients; and applying the selected set of filter coefficients to the digital filter.

2. A method as claimed in claim 1, wherein the step of determining the resonant frequency of the speaker comprises determining said resonant frequency from a plurality of predetermined frequencies.

3. A method as claimed in claim 2, wherein the plurality of prestored sets of filter coefficients comprise one prestored set of filter coefficients corresponding to each of said plurality of predetermined frequencies.

4. A method as claimed in claim 2, wherein the step of determining the resonant frequency comprises applying signals to the speaker at each of said predetermined frequencies, and detecting a resulting current.

5. A method as claimed in claim 4, comprising applying to the speaker a composite signal containing components at each of said predetermined frequencies, and using a digital Fourier transform to detect resulting currents at each of said predetermined frequencies.

6. A method as claimed in claim 1, comprising determining the resonant frequency of the speaker at a time when the speaker has been receiving a signal.

7. A method as claimed in claim 2, wherein the step of determining the resonant frequency of the speaker comprises detecting currents at each of said predetermined frequencies, resulting from application of a voice or noise cancellation signal to the speaker.

8. A noise cancellation system, for use in a device comprising a speaker for receiving a wanted signal and generating a sound signal therefrom, the noise cancellation system comprising:

a digital filter, for generating a noise cancellation signal from an input signal representative of ambient noise; and an output for applying the noise cancellation signal to the speaker in addition to the wanted signal to generate a sound signal from which the ambient noise has been at least partially cancelled, wherein the noise cancellation system is adapted to:

determine a resonant frequency of the speaker;

in response to the determination of the resonant frequency, select a set of filter coefficients from a plurality of prestored sets of filter coefficients; and apply the selected set of filter coefficients to the digital filter.

9. A method as claimed in 1, wherein the step of determining the resonant frequency of the speaker comprises determining said resonant frequency from a plurality of predetermined frequencies.

10. A noise cancellation system as claimed in claim 8, adapted to determine the resonant frequency of the speaker by determining said resonant frequency from a plurality of predetermined frequencies.

11. A noise cancellation system as claimed in claim 10, wherein the plurality of prestored sets of filter coefficients comprise one prestored set of filter coefficients corresponding to each of said plurality of predetermined frequencies.

12. A noise cancellation system as claimed in claim 10, adapted to determine the resonant frequency by applying signals to the speaker at each of said predetermined frequencies, and detecting a resulting current.

13. A noise cancellation system as claimed in claim 12, adapted to apply to the speaker a composite signal containing components at each of said predetermined frequencies, and adapted to use a digital Fourier transform to detect resulting currents at each of said predetermined frequencies.

14. A noise cancellation system as claimed in claim 8, adapted to determine the resonant frequency of the speaker at a time when the speaker has been receiving a signal.

15. A noise cancellation system as claimed in claim 10, adapted to determine the resonant frequency of the speaker by detecting currents at each of said predetermined frequencies, resulting from application of a voice or noise cancellation signal to the speaker.

16. A noise cancellation system as claimed in claim 8, adapted to determine the resonant frequency of the speaker by determining said resonant frequency from a plurality of predetermined frequencies.

17. An integrated circuit, comprising:

a noise cancellation system according to claim 8.

18. A mobile phone, comprising:

an integrated circuit as claimed in claim 17.

19. A pair of headphones, comprising:

an integrated circuit as claimed in claim 17.

20. A pair of earphones, comprising:

an integrated circuit as claimed in claim 17.

21. A headset, comprising:

an integrated circuit as claimed in claim 17.

* * * * *

UNITED STATES PATENT AND TRADEMARK OFFICE

CERTIFICATE OF CORRECTION

PATENT NO. : 8,670,571 B2
APPLICATION NO. : 12/809028
DATED : March 11, 2014
INVENTOR(S) : Richard Clemow It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 425 days.

Signed and Sealed this
Twenty-ninth Day of September, 2015

Michelle K. Lee

Michelle K. Lee
*Director of the United States Patent and Trademark Office*